US008167398B2

(12) United States Patent
Suzuki

(10) Patent No.: US 8,167,398 B2
(45) Date of Patent: May 1, 2012

(54) LIQUID JET HEAD

(75) Inventor: Yoshihumi Suzuki, Ena (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 321 days.

(21) Appl. No.: 12/646,325

(22) Filed: Dec. 23, 2009

(65) Prior Publication Data

US 2010/0165023 A1 Jul. 1, 2010

(30) Foreign Application Priority Data

Dec. 26, 2008 (JP) ..... 2008-331806

(51) Int. Cl.
*B41J 29/38* (2006.01)

(52) U.S. Cl. ..... 347/17

(58) Field of Classification Search ..... 347/9–11, 347/17

See application file for complete search history.

(56) References Cited

U.S. PATENT DOCUMENTS 6,652,057 B2 * 11/2003 Masuda et al. ..... 347/14
7,226,141 B2 * 6/2007 Asano et al. ..... 347/10
2002/0130940 A1 9/2002 Suzuki et al.

FOREIGN PATENT DOCUMENTS

JP H11-091127 A 4/1999
JP 2002-264362 A 9/2002
JP 2003-182103 A 7/2003

* cited by examiner

*Primary Examiner* — An Do
(74) *Attorney, Agent, or Firm* — Baker Botts L.L.P.

(57) ABSTRACT

A recording apparatus includes: a recording head that has: an inlet; an outlet; a supply and discharge flow path; a nozzle; and a liquid supply flow path, a liquid flow forming unit that forms a flow of liquid toward the outlet in the supply and discharge flow path; a first temperature sensor; a second temperature sensor; a heating unit; and a control unit that controls the liquid flow forming unit and the heating unit on the basis of a first detection temperature and a second detection temperature, wherein the first temperature sensor is disposed in a first position between the inlet and the communicating position of the liquid supply flow path, wherein the second temperature sensor is disposed in a second position between the outlet and the communicating position, wherein the heating unit is disposed in a third position between the inlet and the communicating position.

10 Claims, 10 Drawing Sheets

(FIG.8 CONTINUED)
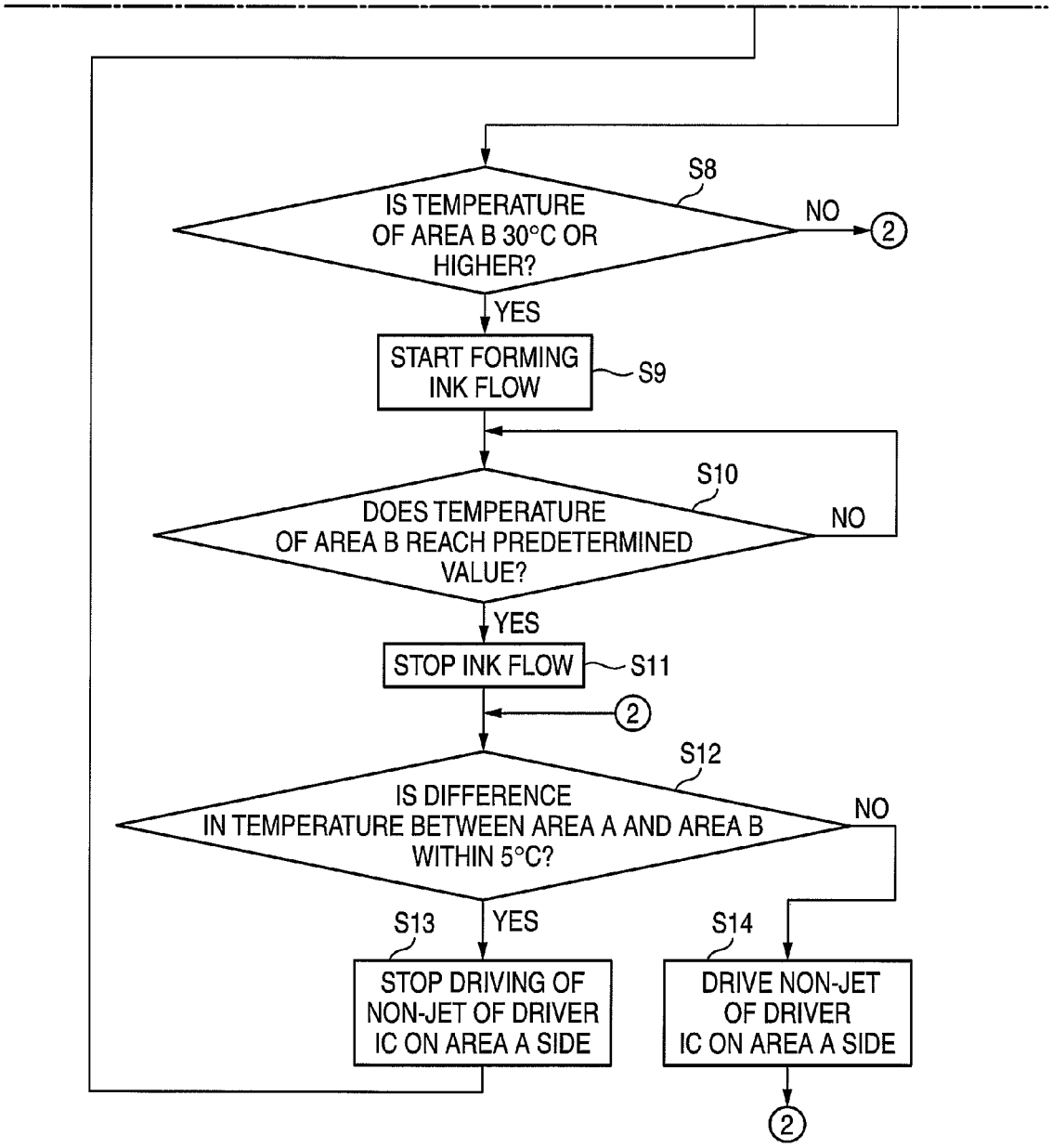

LIQUID JET HEAD

CROSS REFERENCE TO RELATED APPLICATION

The present application claims priority from Japanese Patent Application No. 2008-331806, which was filed on Dec. 26, 2008, the disclosure of which is herein incorporated by reference in its entirety.

TECHNICAL FIELD

Apparatuses and devices consistent with the present invention relate to a liquid jet head having a liquid supply flow path for supplying liquid through nozzles formed therein.

BACKGROUND

A related art discloses an example of an apparatus having a unit for heating liquid that is supplied to a head jetting liquid. In the related art, a supply pipe for supplying liquid (ink) to a head is provided with a temperature detecting unit, and the liquid in the supply pipe is heated on the basis of the detection result.

SUMMARY

When variation in temperature of liquid occurs in a recording head, variation in the viscosity of liquid may occur and in the jet characteristics of liquid jetted from nozzles. Thus, it is conceivable that the liquid is heated so as not to cause variation in temperature. Even when the inside of a supply pipe for supplying liquid to a head, that is, liquid outside of the head, is heated as disclosed in the related art, it is difficult to solve variation in temperature of liquid in the head.

An object of the invention is to provide a recording apparatus capable of easily solving the problem of variation in temperature of liquid in a recording head.

According to an illustrative aspect of the present invention, there is provided a recording apparatus comprising: a recording head that comprises: an inlet for liquid; an outlet for liquid; a supply and discharge flow path extending from the inlet to the outlet; a nozzle for jetting liquid; and a liquid supply flow path communicating with the supply and discharge flow path and the nozzle so as to supply liquid from the supply and discharge flow path to the nozzle, the liquid supply flow path communicating with the supply and discharge flow path at a communicating position, a liquid flow forming unit that supplies liquid from the inlet into the supply and discharge flow path and forms a flow of liquid toward the outlet in the supply and discharge flow path; a first temperature sensor that detects temperature of the recording head; a second temperature sensor that detects temperature of the recording head; a heating unit that heats the recording head; and a control unit that controls the liquid flow forming unit and the heating unit on the basis of a first detection temperature detected by the first temperature sensor and a second detection temperature detected by the second temperature sensor, wherein the first temperature sensor is disposed in the vicinity of a first position between the inlet and the communicating position of the liquid supply flow path along the supply and discharge flow path, wherein the second temperature sensor is disposed in the vicinity of a second position between the outlet and the communicating position along the supply and discharge flow path, wherein the heating unit is disposed in the vicinity of a third position between the inlet and the communicating position along the supply and discharge flow path, and wherein the control unit controls the heating unit and the liquid flow forming unit to decrease differences between the first detection temperature and the second detection temperature.

According to the recording apparatus of the invention, while the liquid flow forming unit supplies liquid from the outside to the supply and discharge flow path, the liquid flow forming unit forms a flow of liquid in the supply and discharge flow path. Accordingly, while the warmed supply and discharge flow path is cooled, it is possible to solve variation in temperature of liquid in the flow path. In addition, it is possible to heat liquid in the supply and discharge flow path by using the heating unit at the upstream side of the position communicating with the liquid supply flow path. The control unit controls the liquid flow forming unit and the heating unit on the basis of the difference between the detection temperatures detected by the two temperature sensors, and thus it is possible to appropriately solve variation in temperature of liquid in the recording head.

According to the recording head of the invention, while the liquid flow forming unit supplies liquid from the outside to the supply and discharge flow path, the liquid flow forming unit forms flows of liquid in the supply and discharge flow path. Accordingly, while the warmed supply and discharge flow path is cooled, it is possible to solve variation in temperature of liquid in the flow path. In addition, it is possible to heat liquid in the supply and discharge flow path by using the heating unit at the upstream of the position communicating with the liquid supply flow path. The control unit controls the liquid flow forming unit and the heating unit on the basis of the difference between the detection temperatures detected by the two temperature sensors, and thus it is possible to appropriately solve variation in temperature of liquid in the recording head.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Hereinafter, a preferred embodiment of the invention will be described with reference to the drawings.

Figure 1:
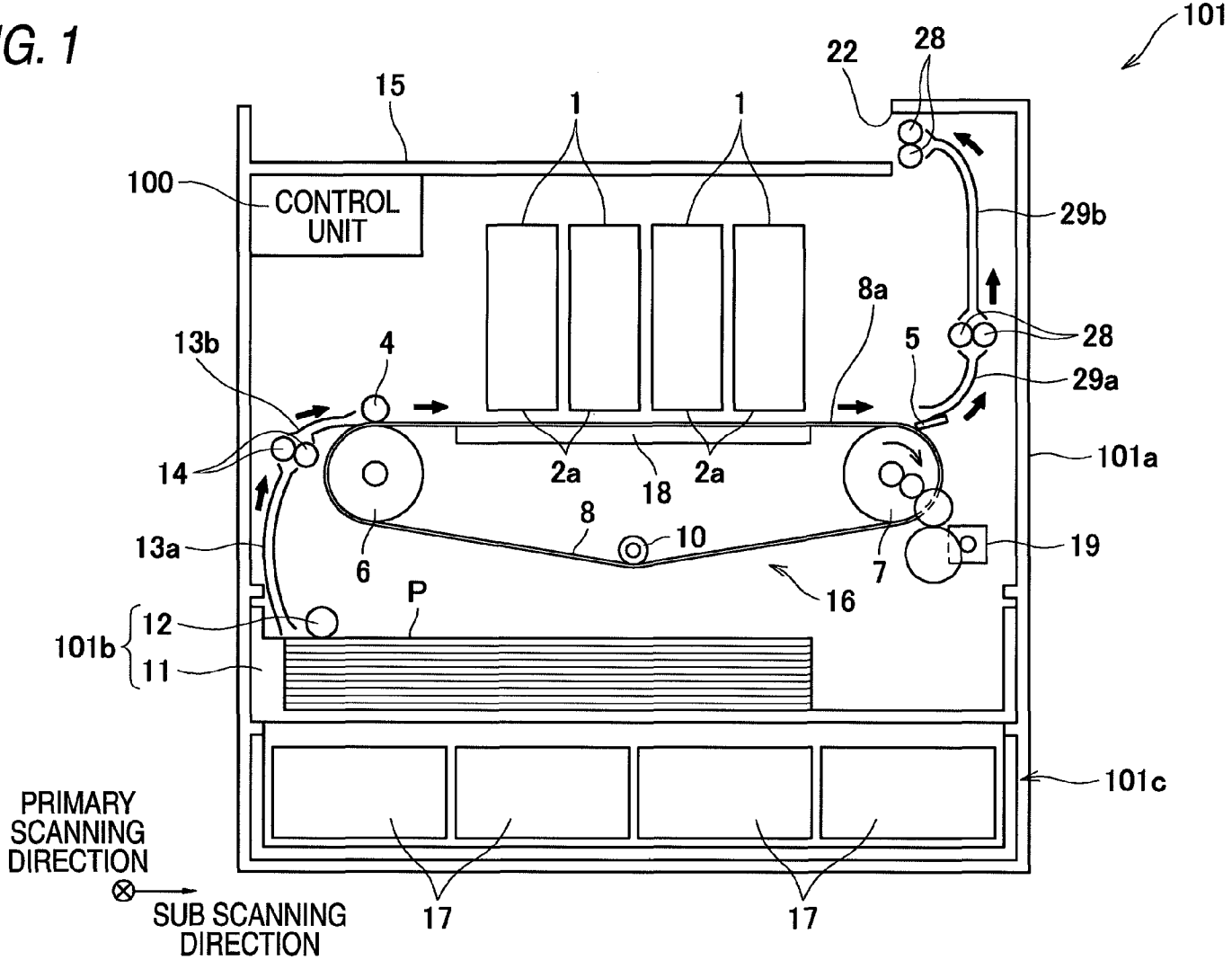
FIG. 1 is a longitudinal cross-sectional view illustrating an inner configuration of an ink jet printer including an ink jet head according to an embodiment of the invention.

FIG. 1 is a longitudinal cross-sectional view illustrating an inner configuration of an ink jet printer including an ink jet head according to an embodiment of the invention. As shown in FIG. 1, an ink jet printer 101 has a rectangular parallelepiped case 101*a*. Four ink jet heads 1 (hereinafter, referred to as heads 1) jetting ink of magenta, cyan, yellow, and black, and a transport mechanism 16 are disposed in the case 101*a*. A control unit 100 controlling an operation of the heads 1 or the transport mechanism 16 is provided on an inner face of a top plate of the case 101*a*. A paper feed unit 101*b* detachable from the case 101*a* is disposed under the transport mechanism 16. An ink tank unit 101*c* detachable from the case 101*a* is disposed under the paper feed unit 101*b*.

A paper transport path is formed along thick arrows shown in FIG. 1 in the ink jet printer 101, and sheets of paper P are transported from the paper feed unit 101*b* toward a paper discharge unit 15. The paper feed unit 101*b* has a paper feed tray 11 and a paper feed roller 12. The paper feed tray 11 has a box shape which opens upward, and stacked sheets of paper p are stored therein. The paper feed roller 12 transports the top sheet of paper P in the paper feed tray 11.

The discharged sheet of paper P is guided by guides 13*a* and 13*b*, and is transported to the transport mechanism 16 while being pinched by a pair of transport rollers 14.

The transport mechanism 16 has two belt rollers 6 and 7, a transport belt 8, a tension roller 10, and a platen 18. The transport belt 8 is an endless belt wound so as to be suspended between the both rollers 6 and 7. The tension roller 10 is pushed downward in a lower loop of the transport belt 8 while coming into contact with an inner peripheral face thereof, and applies tension to the transport belt 8. The platen 18 is disposed in an area surrounded with the transport belt 8, and supports the transport belt 8 so as not to bend the transport belt 8 downward at a position opposed to the heads 1. The belt roller 7 is a driving roller, and rotates clockwise in FIG. 1 by applying a driving force from a transport motor 19 to a shaft of the belt roller 7. The belt roller 6 is a driven roller, and is rotated clockwise in FIG. 1 by the driving of the transport belt 8 due to the rotation of the belt roller 7. The driving force of the transport motor 19 is transferred to the belt roller 7 through a plurality of gears.

An outer peripheral face 8*a* of the transport belt 8 has adhesiveness due to the performing of a silicon process. A nip roller 4 is disposed at a position opposed to the belt roller 6. The nip roller 4 presses the sheet of paper P discharged from the paper feed unit 101*b* onto the outer peripheral face 8*a* of the transport belt 8. While the sheet of paper P pressed onto the outer peripheral face 8*a* is kept on the outer peripheral face 8*a* by the adhesiveness, the sheet of paper P is transported in a paper transport direction (the right in FIG. 1, which is a sub-scanning direction).

A peeling plate 5 is provided at a position opposed to the belt roller 7. The peeling plate 5 peels off the sheet of paper P from the outer peripheral face 8*a*. The peeled sheet of paper P is guided by guides 29*a* and 29*b*, and is transported while being pinched between two pairs of transport rollers 28. The sheet of paper P is discharged from an outlet 22 formed at an upper part of the case 101*a* to a paper discharge concave portion (discharge portion) 15 provided on the upper face of the case 101*a* (top plate).

The four heads 1 jet ink with different colors (magenta, yellow, cyan, and black). The four heads 1 have a substantially rectangular parallelepiped shape extending in a primary scanning direction. The four heads 1 are fixed and arranged along a transport direction A of paper P. That is, the printer 101 is a line-type printer, and the transport direction A is perpendicular to the primary scanning direction.

The bottom faces of the heads 1 are nozzle faces 2*a* on which a plurality of nozzles 108 (see FIG. 5) for jetting ink are formed. While the transported sheet of paper P passes right under the four heads 1, ink with various colors are sequentially jetted from the nozzles 108 onto the upper face of the sheet of paper P. Accordingly, a desired color image is formed on the upper face of the sheet of paper P, that is, a printing face.

The heads 1 are connected to ink tanks 17 in the ink tank unit 101*c*. Ink with colors different from one another is stored in each of the four ink tanks 17. The ink is supplied from the ink tanks 17 to the heads 1 through tubes.

Figure 2:
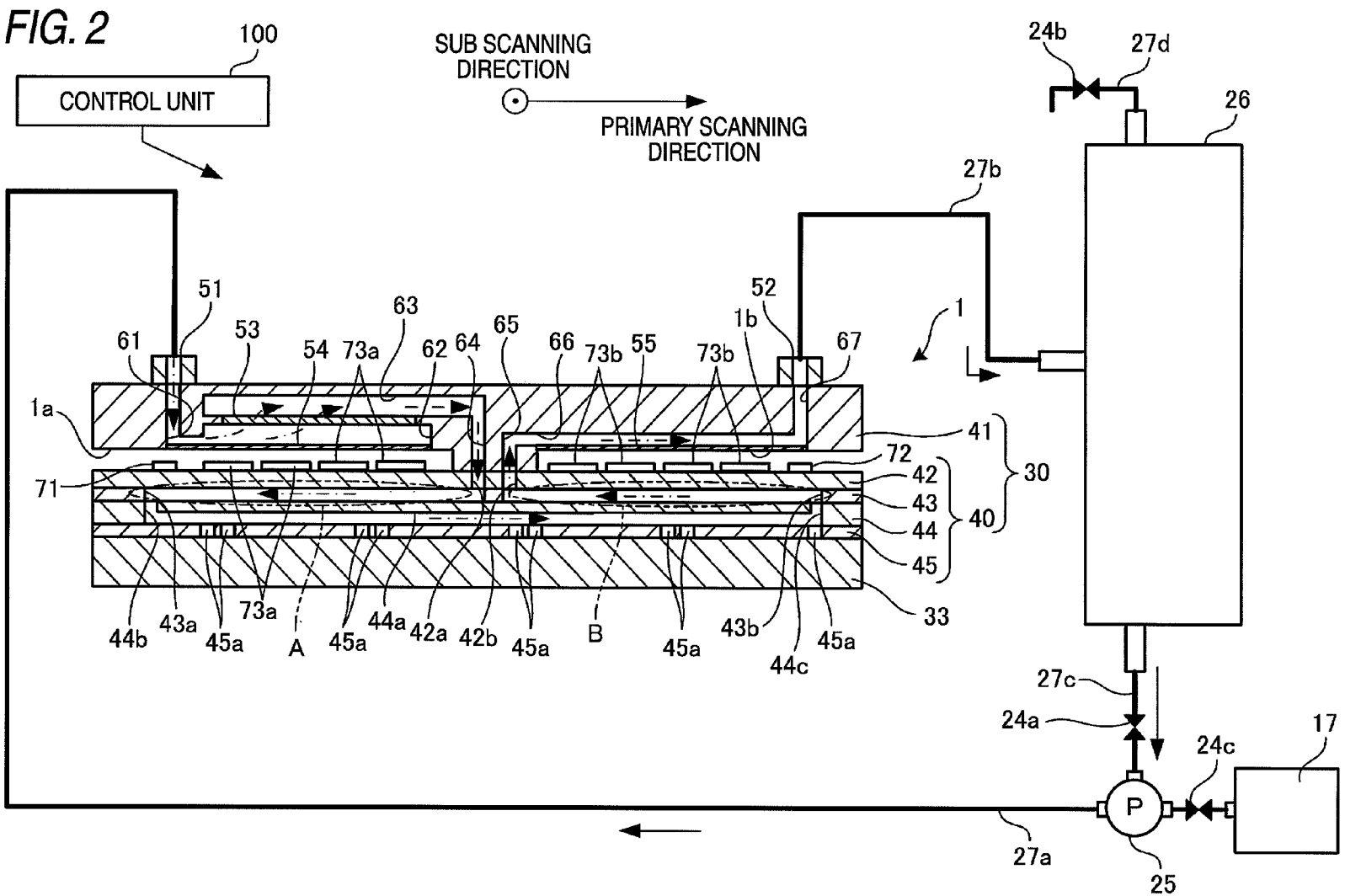
FIG. 2 is a schematic cross-sectional view according to a longitudinal direction of the ink jet head and a schematic view illustrating an ink circulation mechanism connected to the head.

FIG. 2 is a schematic diagram illustrating a peripheral configuration of the head 1 including a longitudinal cross-sectional view of the head 1. The head 1 has a substantially rectangular parallelepiped shape extending in the primary scanning direction. The head 1 has a head body 33 provided with the plurality of nozzles 108 for jetting ink, and a reservoir unit 30 for supplying ink to the head body 33. The reservoir unit 30 is stacked on the head body 33, and an ink inlet 51 and an ink outlet 52 are formed on an upper face of the reservoir unit 30.

The head 1 is connected to an ink circulation mechanism (liquid flow forming unit) which supplies ink to the head 1 and circulates ink inside and outside of the head 1. In the head 1, one part is intensively driven as compared with the other parts, and thus the head 1 may have high temperature in parts. When variation in temperature occurs in ink in the head 1 due to there being high temperature in parts, variation occurs in viscosity of ink. Accordingly, variation may occur in jet characteristics of ink jetted from the head 1. The reason for circulating ink inside and outside of the head 1 by the ink circulation mechanism is to easily solve variation in temperature of the head 1 by generating ink flow through the ink flow path formed in the head 1.

The ink circulation mechanism according to the embodiment includes a pump 25 supplying ink to the head 1 by absorbing ink from the ink tank 17, and a sub-tank (air-liquid separating unit) 26 separating air from the ink. The ink circulation mechanism includes an ink tube 27*a* connecting the pump 25 and the ink inlet 51, an ink tube 27*b* connecting the ink outlet 52 and an inlet of the sub-tank 26, and an ink tube 27*c* connecting an outlet of the sub-tank 26 and the pump 25. The ink tube 27*c* is provided with an on-off valve 24*a* to start and stop circulation. An air discharge tube 27*d* is provided at the upper part of the sub-tank 26, to which an on-off valve 24*b* is connected, and air in the sub-tank 26 can be discharged to the atmosphere. An on-off valve 24*c* is provided between the ink tank 17 and the pump 25. The pump 25 and the on-off valves 24*a* to 24*c* are controlled by the control unit 100.

The reservoir unit 30 has a filter unit 41 integrally formed of resin, and a laminated body 40 formed of a plurality of laminated metal plates 42 to 45. The filter unit 41 and the laminated body 40 are opposed with gaps 1*a* and 1*b* formed along the primary scanning direction therebetween. Ink flow paths 61 to 67 are formed in the filter unit 41, and an ink flow path formed from through-holes 42*a*, 43*a*, and the like is formed in the laminated body 40. A connection portion 41*a* connected to the laminated body 40 protruding toward the laminated body 40 is formed under the filter unit 41, and the ink flow path of the filter unit 41 and the ink flow path of the laminated body 40 are connected to each other through the connection portion 41*a*. In the embodiment, the connection portion 41*a* is provided substantially at the center of the filter unit 41 with respect to the primary scanning direction. The gaps 1*a* and 1*b* are formed on both sides of the primary scanning direction with the connection portion 41*a* therebetween, and have substantially the same length.

A configuration of the filter unit 41 will be described. The ink flow path 61 communicates with the ink inlet 51 at the upper end thereof. When ink is supplied from the ink tube 27*a*, the ink flows into the ink flow path 61 through the ink inlet 51. The ink flow path 61 extends substantially vertically downward at the vicinity of one end (vicinity of the left end in FIG. 2) of the filter unit 41, and communicates with one end of the ink flow path 62 at the lower end thereof. The ink flow path 62 extends from the position communicating with the ink flow path 61 to the vicinity of the connection portion 41*a* along the gap 1*a*. The ink flow path 62 is opened to the lower face of the filter unit 41, and the opening is sealed up by a damper film 54 that is a thin film made of resin. The damper film 54 is displaced according to vibration of ink, thereby absorbing and attenuating the vibration of ink.

The ink flow path 63 is opposed to the ink flow path 62 at a portion higher than the ink flow path 62. A filter 53 provided with a plurality of small through-holes for filtrating ink is provided between the ink flow paths 62 and 63. When ink in the ink flow path 62 passes through the filter 53 and flows into the ink flow path 63, foreign materials are removed. The ink flow path 63 extends along the primary scanning direction, and has an opening in the upper face of the filter unit 41. The opening of the ink flow path 63 is sealed up by a damper film 56 that is a thin film made of resin. The damper film 56 functions in the same manner as the damper film 54 with respect to vibration of ink. The ink flow path 63 communicates with the upper end of the ink flow path 64 at the center vicinity of the filter unit 41. The ink flow path 64 extends substantially vertically downward from the position communicating with the ink flow path 63, and communicates with a part of the ink flow path of the laminated body 40 through the connection portion 41*a*.

The ink flow path 65 is formed as a flow path different from the ink flow path 64 in the connection portion 41*a*, and communicates with the other end of the ink flow path of the laminated body 40 at a position different from the ink flow path 64. The ink flow path 65 extends upward in the connection portion 41*a*, and communicates with the ink flow path 66 in the vicinity of a base portion of the connection portion 41*a*. The ink flow path 66 extends to the lower portion of the ink outlet 52 along the primary scanning direction. The ink flow path 66 has an opening in the lower face of the filter unit 41, and the opening is sealed up by a damper film 55 that is a thin film made of resin. The damper film 55 functions in the same manner as the damper film 54 with respect to vibration of ink. The ink flow path 66 communicates with the ink flow path 67 at the lower portion of the ink outlet 52. The ink flow path 67 extends substantially vertically upward from the ink flow path 66 to the ink outlet 52, and communicates with the ink outlet 52.

Next, a configuration of the laminated body 40 will be described. The laminated body 40 has metal plates 42 to 45 provided with holes or a concave portion. The metal plates 42 to 45 are laminated so that the holes or the concave portion communicate with each other to form ink flow paths.

Through-holes 42*a* and 42*b* communicating with the ink flow paths 64 and 65 of the filter unit 41 are formed in the metal plate 42. The through-holes 42*a* and 42*b* penetrate the plate 42 substantially in the lamination direction of the laminated body 40 at a position overlapping with the ink flow paths 64 and 65 in the plan view.

The plate 43 is provided with through-holes 43*a* and 43*b* extending in the primary scanning direction. The through-hole 43*a* communicates with the through-hole 42*a* at the center vicinity of the plate 43, and extends therefrom to the vicinity of the left end of the plate 43 in FIG. 2 along the primary scanning direction. The through-hole 43*b* communicates with the through-hole 42*b* at the vicinity of the center of the plate 43, and extends therefrom to the vicinity of the right end of the plate 43 in FIG. 2 along the primary scanning direction in a direction reverse to the through-hole 42*a*.

The plate 44 is provided with a through-hole 44*b* communicating with the left end of the through-hole 43*a*, and a through-hole 44*c* communicating with the right end of the through hole 43*b*. The plate 44 is provided with a concave portion 44*a* opened to a lower face thereof. The concave portion 44*a* extends from the through-hole 44*b* to the through-hole 44*c* along the primary scanning direction. The opening of the concave portion 44*a* is blocked by the plate 45, and a flow path connecting the through-hole 44*b* and the through-hole 44*c* is formed by the concave portion 44*a*. The plate 45 is provided with a plurality of through-holes 45*a* communicating with the concave portion 44*a*. The through-holes 45*a* are arranged at intervals in the primary scanning direction. The through-holes 45*a* communicates with an ink flow path in a head body 33 to be described later.

As described above, the plates 42 to 45 of the laminated body 40 are provided with the plurality of through-holes or the concave portion, and they communicate with one another, thereby forming the ink flow path from the through-hole 42*a* through the through-holes 43*a* and 44*b*, the concave portion 44*a*, and the through-holes 44*c* and 43*b* to the through-hole 42*b*. In the whole reservoir unit 30, the ink flow path of the laminated body 40 and the ink flow path of the filter unit 41 communicate with each other, thereby forming the supply and discharge flow path from the ink inlet 51 through the ink flow paths 61 to 64, the ink flow path of the laminated body 40, and the ink flow paths 65 to 67 to the ink outlet 52. The plurality of branch flow paths formed of the through-holes 45*a* are branched from the supply and discharge flow path, and the branch flow paths are toward the head body 33.

Driver ICs 73*a* and 73*b* that are electronic components supplying a driving signal to an actuator unit 21 to be described later are provided in the gaps 1*a* and 1*b* between the filter unit 41 and the laminated body 40. Operations of the driver ICs 73*a* and 73*b* are controlled by the control unit 100.

The driver ICs 73*a* and 73*b* are fixed to the upper face of the laminated body 40. With respect to the connection portion 41*a* of the filter unit 41, four driver ICs 73*a* are fixed on the left side in FIG. 2, four driver ICs 73*b* are fixed on the right side in FIG. 2, all of which are arranged along the primary scanning direction. The driver ICs 73*a* are opposed to the ink flow path 62 of the filter unit 41, and is opposed to the through-hole 43*a* of the laminated body 40. The driver ICs 73*b* are opposed to the ink flow path 66 of the filter unit 41, and is opposed to the through-hole 43*b* of the laminated body 40.

Accordingly, the driver ICs 73*a* is disposed in the vicinity of an area A in FIG. 2 in the ink flow path formed in the reservoir unit 30, and the driver IC 73*b* is disposed in the vicinity of an area B in FIG. 2. The area A is an area formed from positions (first and third positions) between the ink inlet 51 and the communicating position of the through-holes 45*a* on the most upstream side in the supply and discharge flow path in the reservoir unit 30, and corresponds to an area included in the through-hole 43*a*. The area B is an area formed from a position (second position) between the ink outlet 52 and the communicating position of the through-holes 45*a* on the most downstream side in the supply and discharge flow path in the reservoir unit 30, and corresponds to an area included in the through-hole 43*b*.

The driver ICs 73*a* and 73*b* are disposed as described above. Accordingly, when the driver ICs 73*a* and 73*b* are operated, heat generated from the driver ICs 73*a* and 73*b* is transferred to ink in the area A or the area B through the metal plate 42 with high thermal conductivity. Therefore, the driver ICs 73*a* and 73*b* serve as a heating unit for heating ink in the ink flow path, as well as supply a driving signal to the actuator unit 21. That is, when ink in the head 1 becomes partially a low temperature, the ink is heated using the heat from the driver ICs 73*a* and 73*b*, thereby solving variation in temperature of the ink.

In the embodiment, since the driver ICs 73*a* and 73*b* are close to the ink flow path formed in the filter unit 41, the heat from the driver ICs 73*a* and 73*b* is easily transferred also to the ink in the filter unit 41. For example, as a part of the supply and discharge flow path in the filter unit 41 (first flow path body), the ink flow path 62 (first part) is formed along the gap 1*a*. The ink flow path 62 communicates with the through-hole 43*a* (second part) formed in the laminated body 40 (second flow path body) through the ink flow path 64 and the through-hole 42*a* (communicating flow path) and along the gap 1*a*. Since the driver ICs 73*a* are disposed in the gap 1*a*, it is possible to efficiently heat all of the ink in the ink flow path formed along the gap 1*a*.

Temperature sensors 71 and 72 detecting the temperature of the head 1 are fixed onto the upper face of the laminated body 40. The temperature sensor 71 is disposed in the vicinity of the area A, and detects temperature in the vicinity of the area A of the head 1. The temperature sensor 72 is disposed in the vicinity of the area B, and detects temperature in the vicinity of the area B of the head 1. As shown in FIG. 2, the temperature sensor 71 is opposed to the left end of the area A, and the temperature sensor 72 is opposed to the right end of the area B. Accordingly, in the head 1, it is possible to detect a difference in temperature between the downstream vicinity of the area A and the upstream vicinity of the area B. The detection results of the temperature sensors 71 and 72 are input to the control unit 100.

In the embodiment, as described above, the temperature sensors 71 and 72 are disposed substantially at both ends of the laminated body 40 with respect to the primary scanning direction, but are not limited thereto. Since they easily reach relatively high temperatures, they may be disposed at the center of the disposition of the driver ICs 73*a*. Of course, the driver ICs 73*a* may be disposed close to the connection portion 41*a*. The disposition of the driver ICs 73*b* may be applied in the same manner.

Next, an operation of the ink circulation mechanism will be described. When ink is supplied to the head 1 while the ink is being circulated, the control unit 100 drives the pump 25 with the on-off valve 24*a* opened, the on-off valve 24*b* opened, and the on-off valve 24*c* opened. Accordingly, the ink from the ink tank 17 is supplied to the head 1 through the ink tube 27*a* and the ink inlet 51, and the ink from the head 1 flows into the sub-tank 26 through the ink outlet 52 and the ink tube 27*b*. In the sub-tank 26, air is separated from the ink, moved upward, and is discharged to the atmosphere through the air discharge tube 27*d*.

Meantime, in the head 1, as shown by a dashed-dotted line in FIG. 2, the ink flowing in from the ink inlet 51 flows toward the ink outlet 52 through the filter unit 41 and the supply and discharge flow path formed in the laminated body 40. When this state is kept during a predetermine time period, the supply and discharge flow path in the reservoir unit 30 is filled with new ink from the ink tank 17. At this time, it is preferable to drive the pump 25 to the extent that there is no inflow of ink to the head body 33 through the through-holes 45*a*. Accordingly, destruction of a meniscus formed in an outlet 108 of the head body 33 is suppressed.

When ink is introduced to the head 1 for the first time, the pump 25 is driven with the on-off value 24 closed and the on-off valves 24*b* and 24*c* opened, thereby filling the supply and discharge flow path with the ink. Then, the pump 25 is powerfully driven with the on-off valve 24*a* opened and the on-off valve 24*b* closed by the control unit 100, thereby allowing the ink to flow into the head body 33 through the through-holes 45*a*. Accordingly, the head 1 is filled with the ink from the ink tank 17.

Next, formation of ink circulation flow for circulating ink inside and outside of the head 1 will be described. When the ink circulation flow is formed, the control unit 100 drives the pump 25 with the on-off valve 24*a* opened, the on-off valve 24*b* closed, and the on-off valve 24*c* closed. Accordingly, the ink from the sub-tank 26 is supplied to the head 1 through the ink tube 27*a* and the ink inlet 51. The ink flowing into the head 1 passes through the supply and discharge flow path in the reservoir unit 30 and flows into the sub-tank 26 through the ink outlet 52 and the ink tube 27*b*. The ink in the sub-tank 26 passes through the ink tube 27*c*, the pump 25, and the ink tube 27*a*, and flows into the head 1 again.

Figure 3:
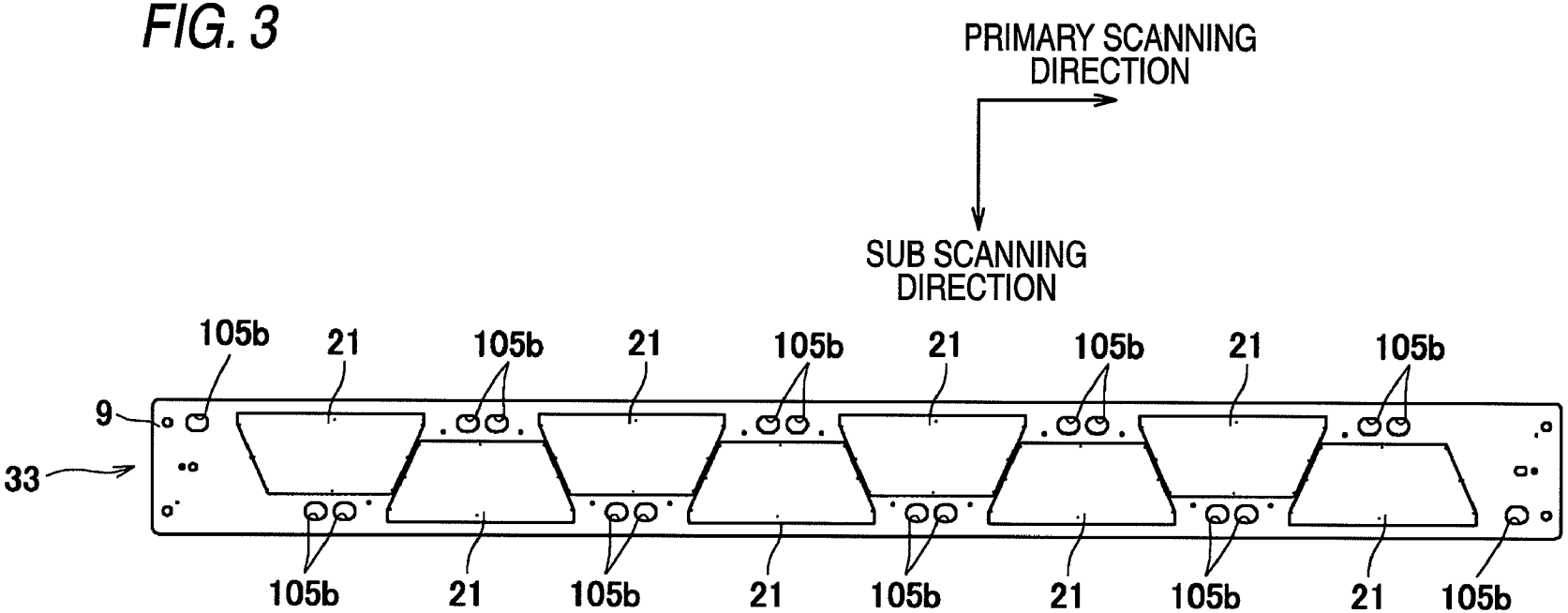
FIG. 3 is a plan view of a head body included in the ink jet head.
Figure 4:
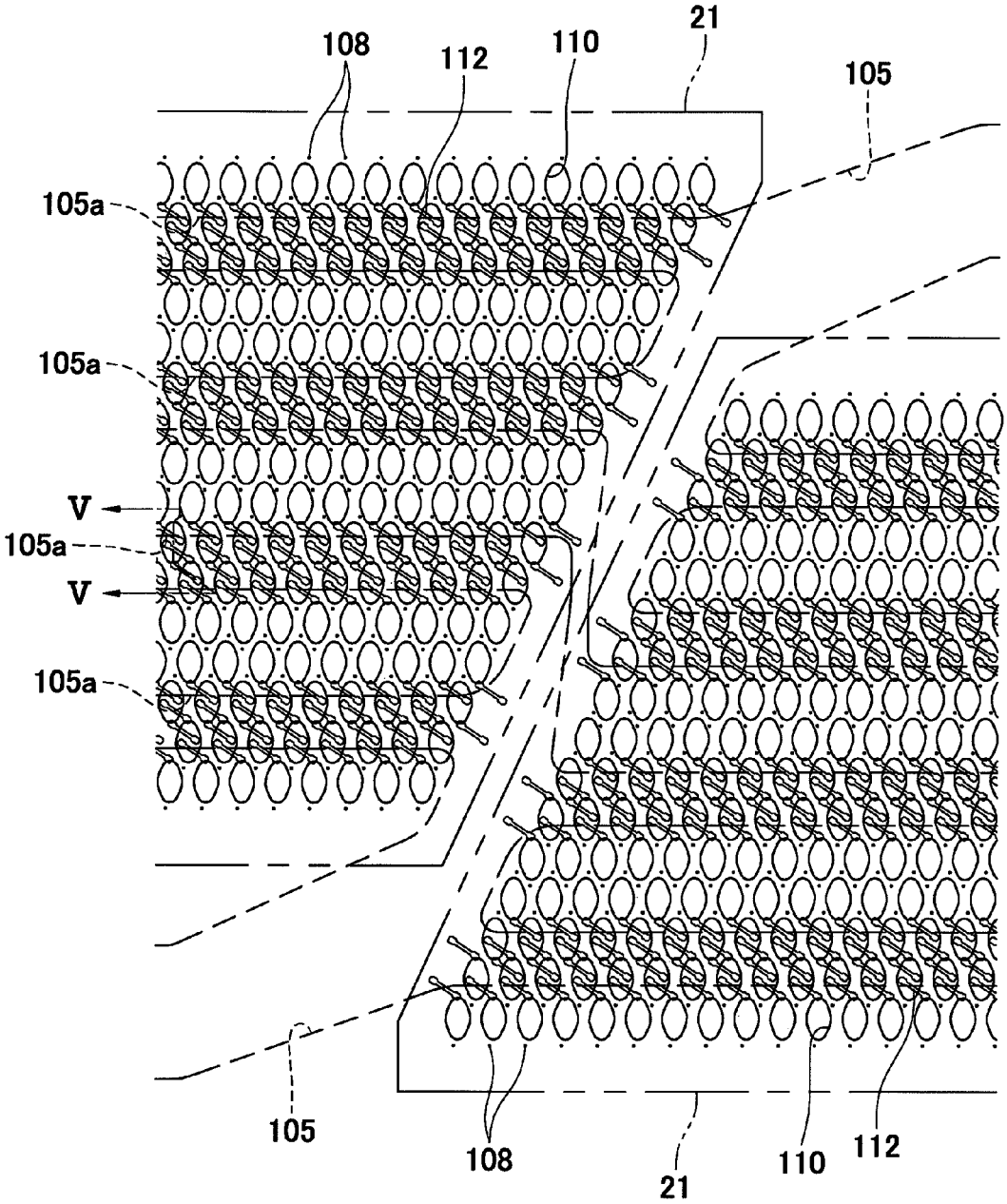
FIG. 4 is a partially enlarged plan view of FIG. 3.
Figure 5:
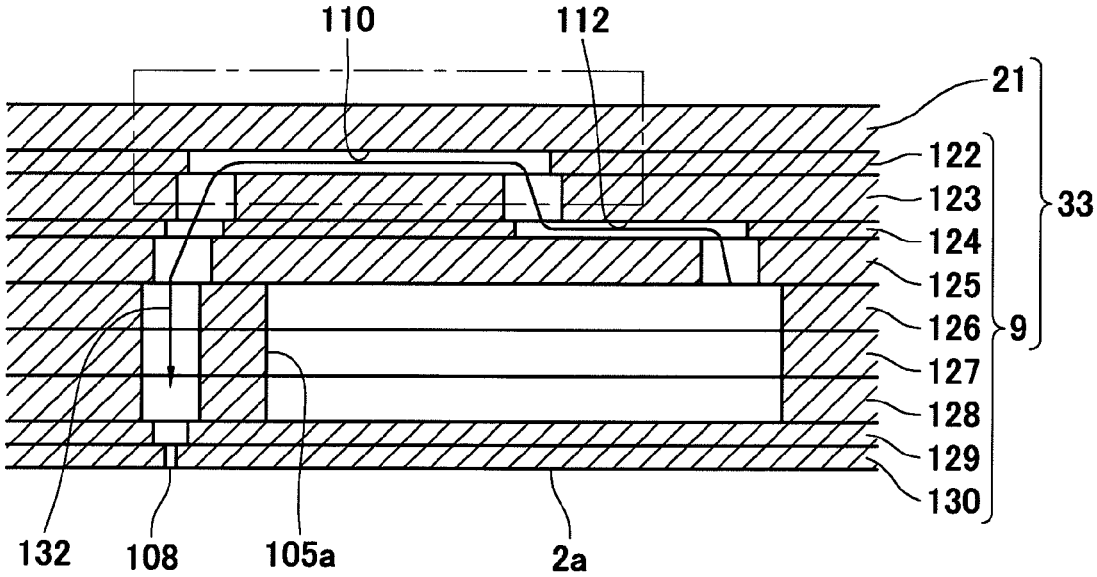
FIG. 5 is a cross-sectional view taken along Line V-V shown in FIG. 4.
Figure 6A:
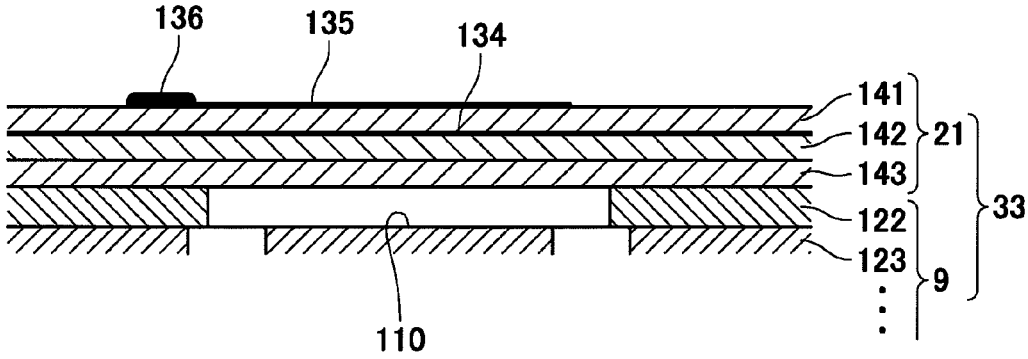
FIG. 6A is an enlarged cross-sectional view of an actuator unit and FIG. 6B is a plan view of an individual electrode.
Figure 6B:
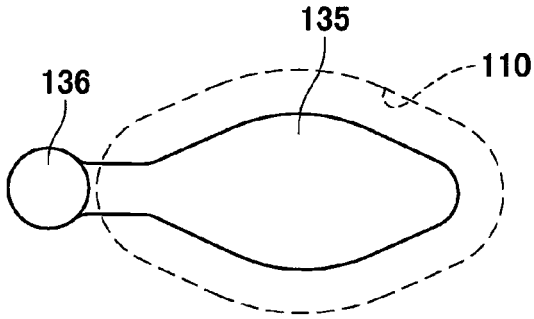

Hereinafter, the head body 33 will be described. FIG. 3 is a plan view of the head body 33. FIG. 4 is a partially enlarged view of a part of two neighboring actuator units 21 in FIG. 3. FIG. 5 is a partial cross-sectional view of a flow path unit 9 taken along line V-V shown in FIG. 4. FIG. 6A and FIG. 6B are an enlarged cross-sectional view of an area shown by a dashed-dotted line in FIG. 5 and a plan view of an individual electrode. In FIG. 4, to easily comprehend the figure, an aperture 112, which should be drawn by a broken line, is drawn by a solid line.

The head body 33 includes the flow path unit 9 and eight actuator units 21. The actuator units 21 have substantially a trapezoid plane shape, and are fixed onto the upper face of the flow path unit 9. The eight actuator units 21 are arranged so that a trapezoid upper base conforms to two virtual lines parallel to the primary scanning direction, and four actuator units 21 are arranged on each virtual line differently from each other in the primary scanning direction so that oblique sides of the trapezoids are close and parallel to each other. Accordingly, the oblique sides of the trapezoids of two neighboring actuator units 21 overlap with each other with respect to the primary scanning direction and the sub-scanning direction.

Each actuator unit 21 includes a plurality of piezoelectric actuators applying jetting energy to ink in a pressure chamber 110 (see FIG. 4). An end portion of a flat flexible board 1 is bonded to the upper face of each actuator unit 21. In the flexible board, any one of the driver ICs 73*a* and IC 73*b* is mounted. The actuator unit 21 and the driver IC 73*a* and IC 73*b* are connected to each other one to one in order of arrangement with respect to the primary scanning direction. That is, assuming that n is any integer from 1 to 8, the n-th actuator unit 21 disposed with respect to the primary scanning direction is connected to the n-th driver IC 73*a* or 73*b* disposed with respect to the primary scanning direction.

An ink inlet 105*b* is formed at a position opposed to each through-hole 45*a*, corresponding to each of the through-holes 45*a* of the reservoir unit 30, on the upper face of the flow path unit 9. In the flow path unit 9, a plurality of manifold flow paths 105 having ink inlets 105*b* at one end are formed, and a plurality of sub-manifold flow paths 105*a* that are common liquid flow paths branched from the manifold flow paths 105 are formed. In the plan view, the manifold flow paths 105 extend from the ink inlets 105*b* along each oblique side of the trapezoid of the actuator unit 21, and are branched to the plurality of sub-manifold flow paths 105*a*. An area of each sub-manifold flow path 105*a* opposed to the actuator unit 21 extends along the primary scanning direction, and joins another manifold flow path 105 on the opposite oblique side of the trapezoid.

As shown in FIG. 4, a plurality of substantially rhombic pressure chambers 110 in the plan view are regularly arranged in matrix on the upper face of the flow path unit 9. The actuator unit 21 includes a plurality of individual electrodes 135 (see FIG. 6A) opposed to the plurality of pressure chambers 110 formed in the flow path unit 9, and has a function of selectively applying jetting energy to ink in the pressure chambers 110. In the actuator unit 21, a part pinched between the individual electrode 135 and the pressure chamber 110 corresponding thereto is one piezoelectric actuator.

As shown in FIG. 5, the flow path unit 9 is formed of nine metal plates, which include a cavity plate 122, a base plate 123, an aperture plate 124, a supply plate 125, three manifold plates 126, 127, and 128, a cover plate 129, and a nozzle plate 130 in order from the top. The nine plates 122 to 130 have a rectangular, plane shape extending in the primary scanning direction.

The nine plates 122 to 130 are aligned to each other and laminated, thereby forming a plurality of individual ink flow paths 132 from the outlet of the sub-manifold flow path 105*a* through the pressure chamber 110 to the outlet 108 in the flow path unit 9. Ink, which is supplied from the through-holes 45*a* of the reservoir unit 30 to the flow path unit 9 through the ink inlet 105*b*, flows from the manifold flow path 105 to the sub-manifold flow path 105*a*. The ink in the sub-manifold flow path 105*a* flows into the individual ink flow path 132, and reaches the nozzles 108 through the aperture 112 serving as a diaphragm and the pressure chamber 110. In the embodiment, the liquid supply flow path for supplying ink from the supply and discharge flow path to the nozzles 108 is formed from the through-holes 45*a* of the reservoir unit 30, the manifold flow path 105 of the head body 33, the sub-manifold flow path 105*a*, and the individual ink flow path 132.

Hereinafter, the actuator unit 21 will be described in more detail. As shown in FIG. 6A, the actuator unit 21 includes three piezoelectric layers 141 to 143 made of ceramics based on plumbum zirconate titanate (PZT) having ferroelectricity. The individual electrode 135 is formed in an area opposed to the pressure chamber 110 on the top piezoelectric layer 141. A common electrode 134 is interposed on the whole face between the top piezoelectric layer 141 and the piezoelectric layer 142 thereunder. As shown in FIG. 6B, the individual electrode 135 has a substantially rhombic plane shape similar to the pressure chamber 110. A part of an acute angled portion in the individual electrode 135 extends to the outside of the pressure chamber 110, a circular land 136 electrically connected to the individual electrode 135 is provided at a leading end thereof. In addition, a land for the common electrode is formed on the upper face of the piezoelectric layer 141, in addition to the land 136 for the individual electrode. The land for the common electrode is connected to the common electrode through a conductor in a through-hole formed in the piezoelectric layer 141.

Ground potential that is a reference potential is applied to the common electrode 134 by the above-described flexible board. The individual electrode 135 is electrically connected to a terminal provided at the driver IC 73*a* or 73*b* through the land 136 and an internal wiring of the flexible board. A driving signal for driving the actuator unit 21 is individually supplied from the driver IC 73*a* or 73*b* to each individual electrode 135. Accordingly, in the actuator unit 21, a part pinched between the individual electrode 135 and the pressure chamber 110 serves as an individual actuator. That is, in the actuator unit 21, a plurality of piezoelectric actuators that are energy applying members are built to be the same in number as that of pressure chambers 110.

A driving method of the actuator unit 21 to jet ink droplets from the nozzles will be described. The piezoelectric layer 141 is polarized in a thickness direction thereof. When electric field is applied to the piezoelectric layer 141 in the polarization direction with the individual electrode 135 having potential different from that of the common electrode 134, the electric field-applied part in the piezoelectric layer 141 serves as an activation portion distorted by the piezoelectric effect. When the direction of the electric field is the same as the polarization direction, the activation portion elongates in a thickness direction and is contracted in a face direction. In this case, the displacement caused by the elongation and the contraction in the face direction is larger than that in the thickness direction. In the actuator unit 21, the piezoelectric layer 141 farthest away from the pressure chamber 110 is a layer including the activation portion, and the lower two piezoelectric layers 142 and 143 close to the pressure chamber 110 are non-activation layer. As shown in FIG. 6A, the piezoelectric layer 143 is fixed onto the upper face of the cavity plate 122 defining the pressure chamber 110. Accordingly, when a difference in distortion occurs between the electric field applied portion in the piezoelectric layer 141 and the lower piezoelectric layers 142 and 143 in a plane direction, all the piezoelectric layers 141 to 143 are deformed into a unimorph to be concave toward the pressure chamber 110. Accordingly, pressure (jetting energy) is applied to the ink in the pressure chamber 110, and a pressure wave is generated in the pressure chamber 110. The generated pressure wave propagates from the pressure chamber 110 to the nozzles 108, thereby jetting ink droplets from the nozzles 108.

Figure 7:
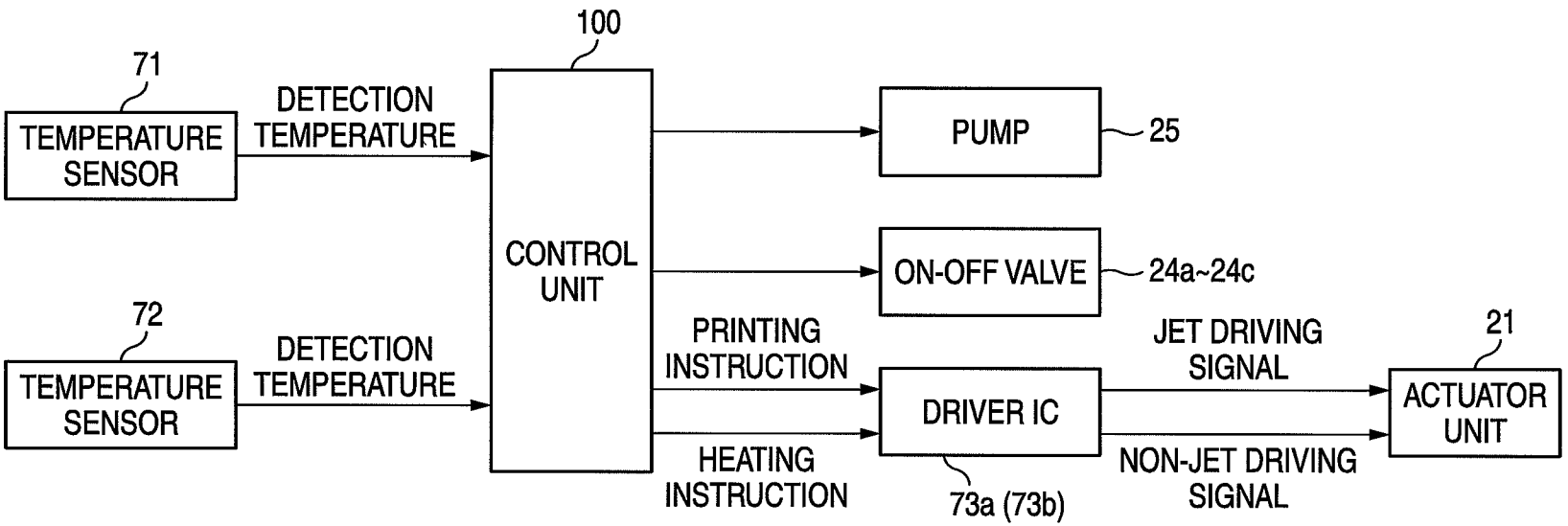
FIG. 7 is a block diagram illustrating a configuration of a control system of the ink jet printer.

Hereinafter, control of each unit performed by the control unit 100 will be described in more detail. FIG. 7 is a block diagram illustrating a configuration of a control system according to the embodiment. The control unit 100 outputs a printing instruction to the driver ICs 73*a* and 73*b* when a color image is formed on a sheet of paper P. The driver ICs 73*a* and 73*b* output a driving signal to the actuator unit 21 on the basis of the instruction output from the control unit 100.

The driver ICs 73*a* and 73*b* according to the embodiment is configured to selectively supply a jet driving signal for driving the actuator unit 21 to jet ink from the nozzles 108, and a non-jet driving signal for driving the actuator unit 21 to the extent that ink is not jetted from the nozzles 108, to the actuator unit 21. When the printing instruction is input from the control unit 100, the driver ICs 73*a* and 73*b* supply the jet driving signal based on the printing instruction to the actuator unit 21. Accordingly, the ink is jetted from the nozzles 108, thereby forming a desired color image on the sheet of paper P.

The non-jet driving signal is adjusted to drive the actuator unit 21 to the extent that the ink is not jetted from the nozzles 108 by applying energy sufficiently smaller than the jetting energy to the pressure chamber 110 or applying pressure to the ink at a timing to cancel out the pressure wave generated in the individual ink flow path 132.

The control unit 100 drives the driver ICs 73*a* and 73*b* to solve variation in temperature of ink in the head 1 on the basis of the detection result from the temperature sensors 71 and 73. For example, when the detection temperature of the temperature sensor 71 is lower than the detection temperature of the temperature sensor 72, a temperature around the area A in FIG. 2 is lower than the temperature around the area B in the head 1. In such a case, the control unit 100 inputs a heating instruction to the driver ICs 73*a* so as to raise the temperature of the area A.

When the heating instruction is input from the control unit 100 to the driver ICs 73*a* and 73*b*, the driver ICs 73*a* and 73*b* supply the non-jet driving signal to the actuator unit 21. At this time, heat is generated by the operation of supplying the non-jet driving signal. Accordingly, the temperature around the area A is raised when the driver ICs 73*a* are operated, and the temperature around the area B is raised when the driver ICs 73*b* are operated.

In the embodiment, assuming that n is any integer from 1 to 8 as described above, the n-th actuator unit 21 disposed with respect to the primary scanning direction is connected to the n-th driver IC 73*a* or 73*b* disposed with respect to the primary scanning direction. Accordingly, when the non-jet driving signal is supplied from the driver ICs 73*a* and 73*b* to the actuator unit 21, heat is generated also from the actuator unit 21 disposed at a position corresponding to the driver IC. Therefore, it is possible to heat a desired part of the head 1 using the actuator unit 21 as well as the driver ICs 73*a* and 73*b*.

To solve variation in temperature of the heat 1, the control unit 100 controls the pump 25 and the on-off valves 24*a* to 24*c* to generate the ink circulation flow inside and outside of the head 1 on the basis of the detection result from the temperature sensors 71 and 73. For example, when parts of the inside of the head 1 are in a high temperature state and the ink circulation flow is generated, the ink from the sub-tank 26 flows into the supply and discharge flow path in the head 1 through the ink inlet 51. The ink in the sub-tank 26 is discharged to the outside of the head 1 once, and thus becomes a temperature lower than that of the ink in the head 1. Accordingly, the high temperature part in the head 1 is cooled by the inflow of the ink from the sub-tank 26. Therefore, it is possible to solve variation in temperature of the head 1.

Figure 8:
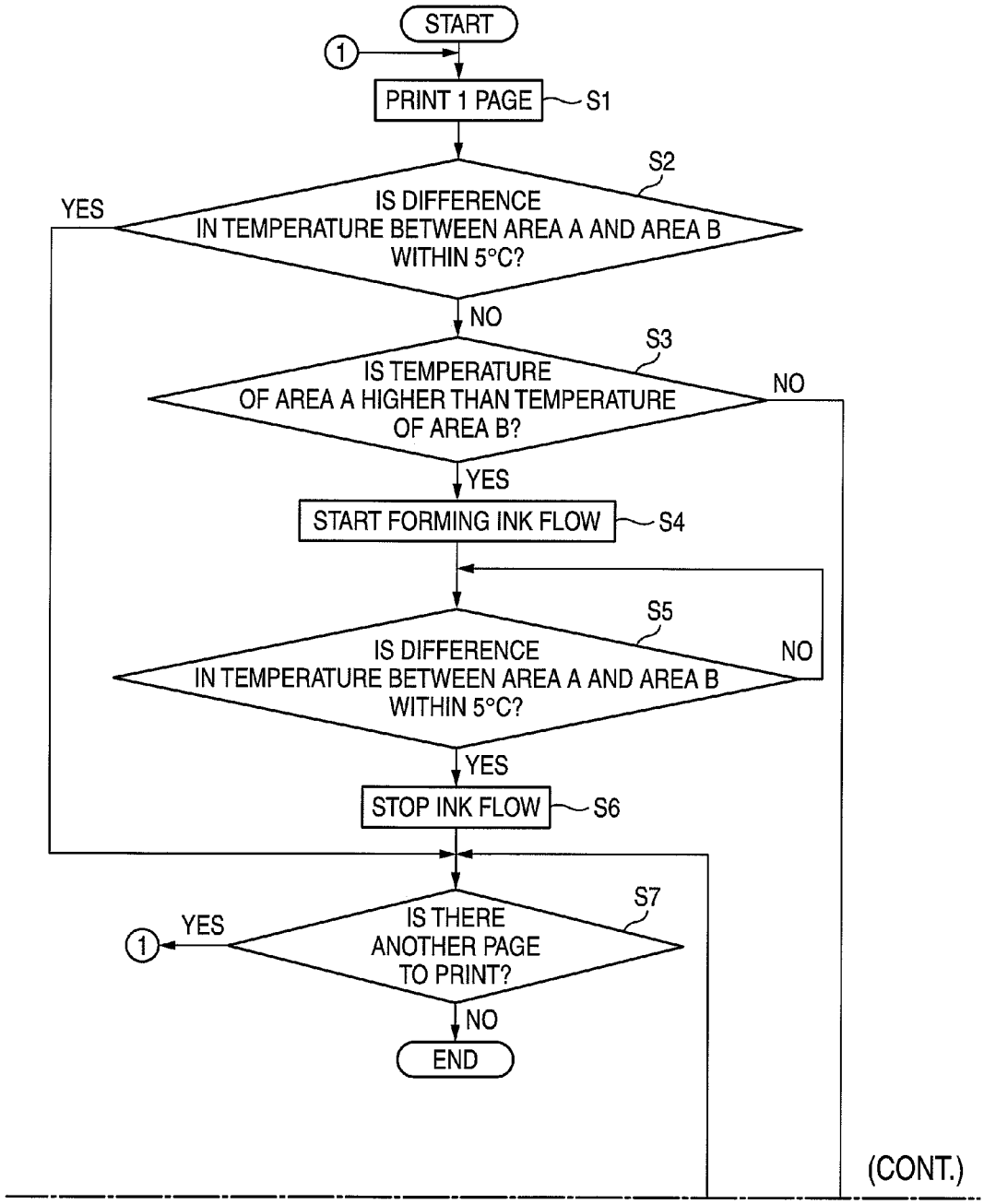
FIG. 8 is a flowchart illustrating a specific example illustrating control performed by a control unit shown in FIG. 1.

In the embodiment, the control unit 100 drives the driver ICs 73*a* and 73*b* to heat the head 1, and thus appropriately combines the formation of the ink circulation flow inside and outside of the head 1, thereby efficiently solving variation in temperature of the head 1. FIG. 8 is a flowchart illustrating a specific example of such a control performed by the control unit 100.

First, when a printing job for one sheet of paper P is performed (Step S1), the control unit 100 determines whether or not an absolute value of a difference in temperature between the detection temperature detected by the temperature sensor 71 and the detection temperature detected by the temperature sensor 72 is 5° C. or less (Step S2). That is, it is determined whether or not the difference in temperature between the temperature around the area A and the temperature around the area B is within 5° C. In this case, 5° C. indicates an acceptable difference in temperature, which does not have an influence on jet characteristics even when variation in temperature occurs in the head 1. The difference in temperature depends on a difference (e.g., difference in temperature-viscosity characteristic) in the properties of ink, and thus may be set to a value other than 5° C. When the control unit 100 determines that the absolute value of the difference in temperature between the detection temperature detected by the temperature sensor 71 and the detection temperature detected by the temperature sensor 72 is 5° C. or less (Step S2: Yes), the process of Step S7 is performed.

When it is determined that the absolute value of the difference in temperature between the detection temperature detected by the temperature sensor 71 and the detection temperature detected by the temperature sensor 72 is more than 5° C. (Step S2: No), the control unit 100 determines whether or not the detection temperature detected by the temperature sensor 71 is higher than the detection temperature detected by the temperature sensor 72 (Step S3). That is, it is determined whether or not the temperature around the area A is higher than the temperature around the area B. When it is determined that the detection temperature detected by the temperature sensor 71 is higher than the detection temperature detected by the temperature sensor 72 (Step S3: Yes), the control unit 100 controls the pump 25 and the on-off valve 24*a* to 24*c* to start forming the ink circulation flow (Step S4). At this time, heat on the upstream side (e.g., around area A) is transferred to the downstream side (e.g., around B) by the ink circulation flow. That is, the upstream side is cooled, and thus the downstream side is heated. While the absolute value of the difference in temperature between the detection temperature detected by the temperature sensor 71 and the detection temperature detected by the temperature sensor 72 is more than 5° C., the control unit 100 continues the ink circulation flow (Step S5: No). When the absolute value of the difference in temperature between the detection temperature detected by the temperature sensor 71 and the detection temperature detected by the temperature sensor 72 is 5° C. or less (Step S5: Yes), the control unit 100 stops the operation of the pump 25 so as to stop the ink circulation flow (Step S6). Then, the process of Step S7 is performed.

Meanwhile, in Step S3, when it is determined that the detection temperature detected by the temperature sensor 71 is equal to or lower than the detection temperature detected by the temperature sensor 72 (Step S3: No), the control unit 100 determines whether or not the detection temperature detected by the temperature sensor 72, that is, the temperature around the area B is 30° C. or higher (Step S8). When the control unit 100 determines that the detection temperature detected by the temperature sensor 72 is lower than 30° C. (Step S8: No), the process of Step S12 is performed. In this case, 30° C. indicates an upper limit of a temperature range for appropriately driving the head 1, for example, a temperature by which the jet characteristics are deteriorated when the temperature of the head 1 exceeds this temperature. The temperature may be set to be a temperature other than 30° C.

Meanwhile, when it is determine that the detection temperature detected by the temperature sensor 72 is 30° C. or higher (Step S8: Yes), the control unit 100 controls the pump 25 and the on-off valves 24*a* to 24*c* to start forming the ink circulation flow (Step S9). While the detection temperature detected by the temperature sensor 72 is higher than a predetermined value, the control unit 100 continues the ink circulation flow (Step S10: No). When the detection temperature detected by the temperature sensor 72 reaches the predetermined value, the control unit 100 stops the operation of the pump 25 so as to stop the ink circulation flow (Step S11). At this time, the heat in the vicinity of the area B on the downstream side is discharged to the outside of the head 1 and the whole head 1 is cooled by the ink circulation flow. The predetermined value is a temperature lower than 30° C., and indicates, for example, a temperature within a range capable of appropriately driving the head 1 such as a temperature for optimizing the jet characteristics of ink.

In Step S12, the control unit 100 determines whether or not the absolute value of the difference in temperature between the detection temperature detected by the temperature sensor 71 and the detection temperature detected by the temperature sensor 72 is 5° C. or less. When it is determined that the absolute value is more than 5° C. (Step S12: No), the control unit 100 outputs a heating instruction to the driver IC 73*a* (Step S14). That is, the non-jet driving signal is supplied from the driver ICs 73*a* disposed in the vicinity of the area A to the actuator unit 21, thereby heating the vicinity of the area A in the head 1 by the driver ICs 73*a*. While the absolute value of the difference in temperature between the detection temperature detected by the temperature sensor 71 and the detection temperature detected by the temperature sensor 72 is more than 5° C., the control unit 100 continuously outputs the heating instruction to the driver ICs 73*a* (Step S14→Step S12: No→Step S14). When it is determined that the absolute value of the difference in temperature between the detection temperature detected by the temperature sensor 71 the detection temperature detected by the temperature sensor 72 is 5° C. or less (Step S12: Yes), the control unit 100 stops the driving of the driver ICs 73*a* (Step S13) and the process of Step S7 is performed.

In Step S7, the control unit 100 determines whether or not there remains a job for printing the next sheet of paper P. When it is determined that there remains the job for printing the next sheet of paper P (Step S7: Yes), the control unit 100 performs the process from the Step S1. Meanwhile, when the control unit 100 determines that there is no remaining job for printing the next sheet of paper P (Step S7: No), the control unit 100 ends a series of processes.

Figure 9A:
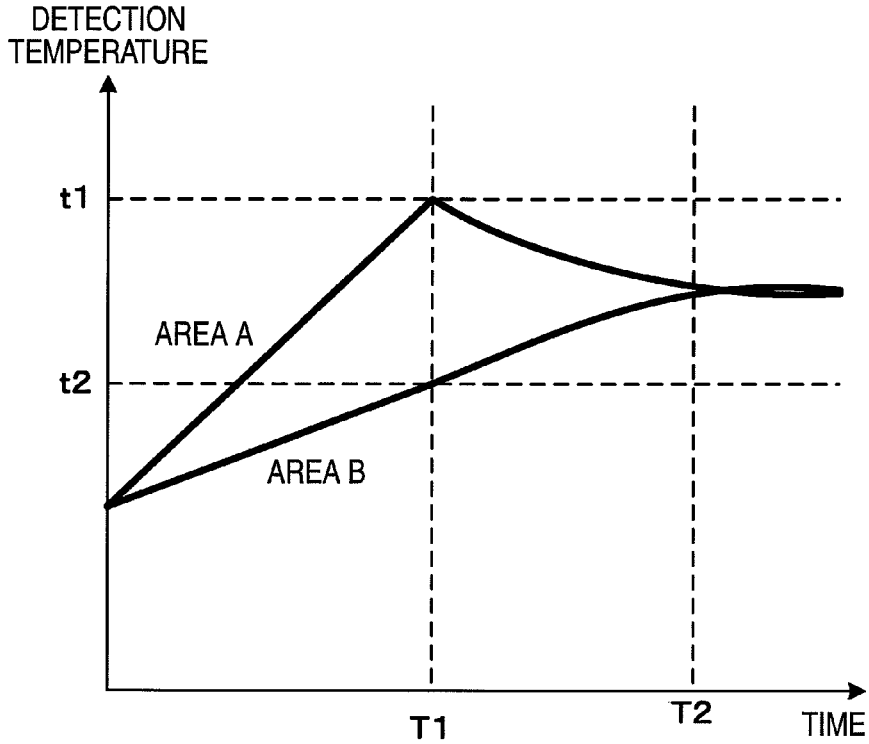
FIGS. 9A and 9B are graphs schematically illustrating an example of change in temperature of the head in the case of applying the control shown in FIG. 8.
Figure 9B:
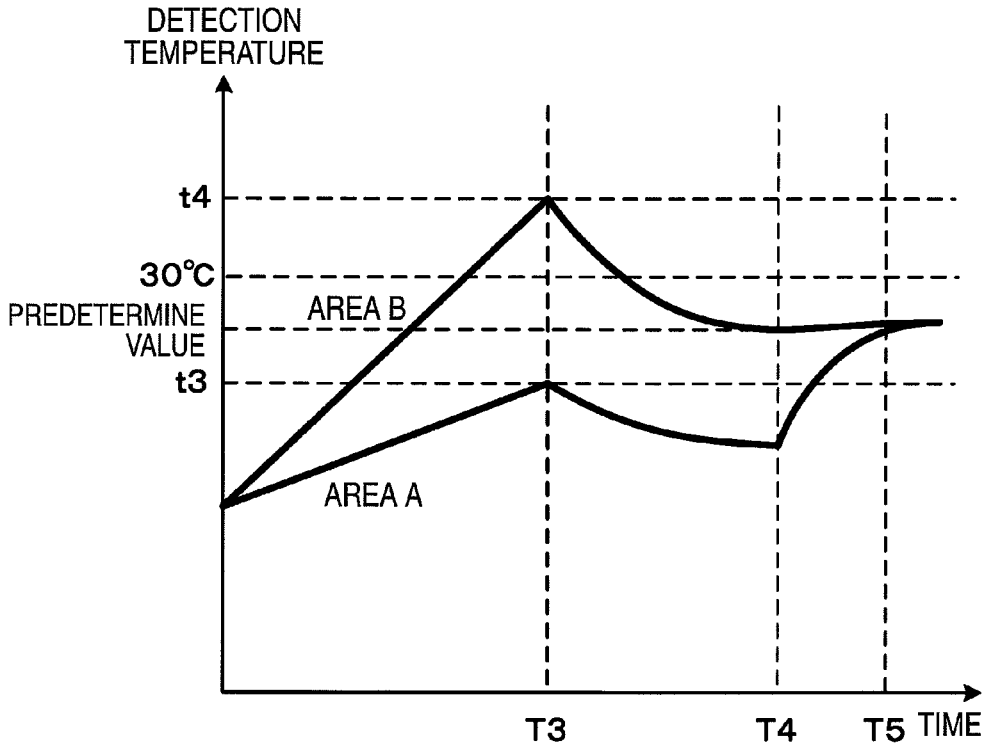

With such a control, variation in temperature occurring in the head 1 is solved as described above. FIG. 9A and FIG. 9B are graphs schematically illustrating an example in the case of applying the control shown in the flowchart of FIG. 8. In the graphs shown in FIG. 9A and FIG. 9B, a horizontal axis represents time, and a vertical axis represents detection temperature of the temperature sensors 71 and 72. The side described by the area A is the detection temperature of the temperature sensor 71, and the side described by the area B is the detection temperature of the temperature sensor 72.

In FIG. 9A, time T1 indicates the time when the printing process (Step S1 in FIG. 8) for one sheet of paper P is completed. Both the temperatures of the area A and the area B are raised by the printing process of the sheet of paper P. At time T1, the temperature t1 around the area A is higher than the temperature t2 around the area B. Herein, it is assumed that a difference between t1 and t2 is more than 5° C. In this case, the control unit 100 starts forming the ink circulation flow (Step S2: No→Step S3: Yes→Step S4).

Accordingly, in the supply and discharge flow path in the head 1, the ink from the sub-tank 26 flows into the vicinity of the area A, and thus the temperature around the area A gets lower than t1 after time T1, as shown in the graph of FIG. 9A. Meanwhile, in the supply and discharge flow path in the head 1, the high temperature ink from the area A flows into the vicinity of the area B, and thus the temperature around the area B gets higher than t2 after time T1, as shown in the graph of FIG. 9A. Accordingly, the temperature around the area A and the temperature around the area B gets closer to being the same value.

At time T2, when the difference in temperature between the temperature around the area A and the temperature around the area B becomes within 5° C., the control unit 100 stops the ink circulation flow (Step S5: Yes→Step S6). As described above, the difference in temperature between the area A and the area B is suppressed, thereby solving variation in temperature.

Meanwhile, the graph of FIG. 9B shows a case where the temperature t3 around the area A is lower than the temperature t4 around the area B at time T3 when the printing process (Step S1 in FIG. 8) for one sheet of paper P is completed, and the difference is more than 5° C. In addition, it is assumed that t4 is higher than 30° C. In this case, the control unit 100 starts forming the ink circulation flow (Step S2: No→Step S3: No→Step S8: Yes→+Step S9).

Accordingly, in the supply and discharge flow path in the head 1, the ink from the sub-tank 26 flows into the vicinity of the area A, and thus the temperature around the area A gets lower than t3 after time T3, as shown in the graph of FIG. 9B. Meanwhile, in the supply and discharge flow path in the head 1, the low temperature ink from the area A flows into the vicinity of the area B, and thus the temperature around the area B becomes lower than t4 after time T3, as shown in the graph of FIG. 9B. As described above, both of the temperature around the area A and the temperature around the area B becomes lower together.

When the temperature of the area B reaches a predetermined value at time T4, the control unit 100 stops the ink circulation flow (Step S10: Yes→Step S11). When the difference between the temperature around the area A and the temperature around the area B is more than 5° C. at time T4, the control unit 100 outputs the heating instruction to the driver ICs 73*a*, and keeps this state while the difference between the temperature around the area A and the temperature around the area B is more than 5° C. (Step S12: No→Step S14→Step S12). Accordingly, the temperature around the area B hardly changes, but the temperature around the area A becomes higher.

At the time T5, when the difference between the temperature around the area A and the temperature around the area B becomes within 5° C., the control unit 100 stops the driving of the driver ICs 73*a* (Step S12: Yes→Step S13). As described above, the difference between the temperature around the area A and the temperature around the area B is suppressed, thereby solving variation in temperature and adjusting any temperature so that it is close to a predetermined value.

According to the embodiment, the pump 25 of the ink circulation mechanism is driven, thereby returning the ink in the supply and discharge flow path to the sub-tank 26 through the ink outlet 52 while supplying the ink from the sub-tank 26 to the supply and discharge flow path through the ink inlet 51. Accordingly, the high temperature part is cooled, and thus it is possible to solve variation in temperature of the head 1. In addition, since the vicinity of the driver ICs 73*a* and 73*b* is heated by driving the driver ICs 73*a* or the driver ICs 73*b*, the low temperature part is heated and thus it is possible to solve variation in temperature of the head 1.

When the detection temperature around the area A is higher than the detection temperature around the area B, the control unit 100 forms the ink circulation flow, thereby lowering the temperature of the area A and raising the temperature of the area B. Accordingly, the difference between the temperature around the area A and the temperature around the area B in the head 1 can be promptly brought within a predetermined range.

When the detection temperature around the area A is equal to or lower than the detection temperature around the area B, the control unit 100 forms the ink circulation flow, thereby lowering the temperatures around the areas A and B together. Then, the control unit 100 drives the driver ICs 73*a* so that the temperature around the area A approaches the temperature around the area B. Also in this case, the difference between the temperature around the area A and the temperature around the area B in the head 1 can be promptly brought within a predetermined range.

As described above, the ink flows from the outside, and thus the area A positioned on the upstream side in the supply and discharge flow path is easily cooled since the heat is easily taken away. In the embodiment, the driver ICs 73*a* are disposed in the vicinity of the area A. Accordingly, it is possible to appropriately solve variation in temperature, using the driver ICs 73*a* as the heating unit.

In the embodiment, the plurality of through-holes 45*a* are branched from the space between the area A and the area B in the supply and discharge flow path. In the case of such a configuration, when variation in temperature occurs in ink in the supply and discharge flow path, variation in temperature may occur between the through-holes 45*a* in the ink supplied from the through-holes 45*a* to the head body 33. Accordingly, variation in temperature between the through-holes 45*a* is appropriately solved by applying the invention capable of appropriately solving variation in temperature to such a configuration, and thus it is possible to effectively suppress variation from occurring in jet characteristics of the ink jetted from the nozzles 108.

MODIFIED EXAMPLE

The preferred embodiment has been described above, but the invention is not limited to the embodiment and may be variously modified within the limit of the scope described in the means for solving the problems.

For example, in the above-described embodiment, the driver ICs 73*a* and the like for driving the actuator units 21 are used as the heating unit for heating the head 1. However, heaters and the like may be used as the heating unit by fixing them onto the upper face of the laminated body 40, separately from the driver ICs 73*a* or 73*b*. In this case, it is not necessary to dispose the driver ICs 73*a* and the like on the upper face of the laminated body 40.

In the above-described embodiment, the driver ICs 73*a* are used as the heating unit, thereby heating the vicinity of the area A corresponding to the upstream side of the supply and discharge flow path in the head 1. However, when the vicinity of the area B corresponding to the downstream side of the supply and discharge flow path is at a low temperature in parts, the driver ICs 73*b* may be used as the heating unit.

In the above-described embodiment, when the driver ICs 73*a* and the like are driven as the heating unit, the non-jet driving signal is supplied to the actuator unit 21. However, the driver ICs 73*a* may be driven to generate heat without supplying any driving signal to the actuator unit 21.

In the above-described embodiment, the ink flows into the ink inlet 51 when the ink circulation flow is formed, and the ink flows from the ink inlet 51 also when the ink is supplied from the ink tank 17 to the head 1. However, when the ink circulation flow is formed and the ink is supplied from the ink tank 17, the ink circulation mechanism may be formed so that inlets for allowing the ink to flow are different from each other. For example, the ink tank 17 may be directly connected to the sub-tank 26 without passing through the pump 25. When the ink circulation flow is formed, the same manner as the above-described embodiment is applied. However, when the ink is supplied from the ink tank 17 to the head 1, the ink from the ink tank 17 may flow into the head 1 through the sub-tank 26 and the ink outlet 52.

In the above-described embodiment, the pump 25 is configured to generate the ink circulation flow by transporting the ink to the ink inlet 51. However, the pump 25 may be configured to generate the ink circulation flow by absorbing the ink from the ink outlet 52.

In the above-described embodiment, the piezoelectric type actuators are used as the actuator units. However, electrostatic type actuators and resistive heating type actuators may be used.

In the above-described embodiment, when the temperature of the area B is higher than the temperature of the area A, the whole head 1 is cooled by the ink circulation flow and then the temperature adjustment between the areas A and B is performed. However, when the ink circulation flow is allowed to flow, the heating of the area A may be started by outputting the heating instruction to the driver ICs 73*a*. The heating start may be performed at the same time as that of forming the ink circulation flow. Alternatively, the start of heating may be performed during a period from time T3 to time T4 and before the temperature of the area B reaches a predetermined value. Accordingly, it is possible to suppress excessive cooling in the area A. The content of the heating instruction to the driver ICs 73*a* may be changed at the boundary of time T4. For example, a driving frequency is raised higher than that before time T4 after time T4, from the viewpoint of balancing the temperatures between the areas A and B for a shorter time.

The above-described embodiment is an example of applying the invention to the ink jet head that jets ink from nozzles, but a target to which the invention can be applied is not limited to such an ink jet head. For example, the invention can be applied to a liquid jet head for forming a minute wiring pattern on a substrate by jetting conductive paste, forming a high precise display by jetting an organic light emitting element onto a substrate, or forming a micro electronic device such as a light guide by jetting optical resin onto a substrate.

According to a first aspect of the present invention, there is provided a recording apparatus comprising: a recording head that comprises: an inlet for liquid; an outlet for liquid; a supply and discharge flow path extending from the inlet to the outlet; a nozzle for jetting liquid; and a liquid supply flow path communicating with the supply and discharge flow path and the nozzle so as to supply liquid from the supply and discharge flow path to the nozzle, the liquid supply flow path communicating with the supply and discharge flow path at a communicating position, a liquid flow forming unit that supplies liquid from the inlet into the supply and discharge flow path and forms a flow of liquid toward the outlet in the supply and discharge flow path; a first temperature sensor that detects temperature of the recording head; a second temperature sensor that detects temperature of the recording head; a heating unit that heats the recording head; and a control unit that controls the liquid flow forming unit and the heating unit on the basis of a first detection temperature detected by the first temperature sensor and a second detection temperature detected by the second temperature sensor, wherein the first temperature sensor is disposed in the vicinity of a first position between the inlet and the communicating position of the liquid supply flow path along the supply and discharge flow path, wherein the second temperature sensor is disposed in the vicinity of a second position between the outlet and the communicating position along the supply and discharge flow path, wherein the heating unit is disposed in the vicinity of a third position between the inlet and the communicating position along the supply and discharge flow path, and wherein the control unit controls the heating unit and the liquid flow forming unit to decrease differences between the first detection temperature and the second detection temperature.

According to the recording apparatus of the invention, while the liquid flow forming unit supplies liquid from the outside to the supply and discharge flow path, the liquid flow forming unit forms a flow of liquid in the supply and discharge flow path. Accordingly, while the warmed supply and discharge flow path is cooled, it is possible to solve variation in temperature of liquid in the flow path. In addition, it is possible to heat liquid in the supply and discharge flow path by using the heating unit at the upstream side of the position communicating with the liquid supply flow path. The control unit controls the liquid flow forming unit and the heating unit on the basis of the difference between the detection temperatures detected by the two temperature sensors, and thus it is possible to appropriately solve variation in temperature of liquid in the recording head.

According to a second aspect of the present invention, in addition to the first aspect, when the first detection temperature is higher than the second detection temperature, the control unit controls the liquid flow forming unit to allow liquid to flow in the supply and discharge flow path until a difference between the first detection temperature and the second detection temperatures is within a predetermined range.

When the first detection temperature on the upstream side in the supply and discharge flow path is higher than the second detection temperature, the flow of liquid from the inlet toward the outlet is formed, thereby decreasing the temperature on the upstream side and increasing the temperature on the downstream side. Accordingly, the difference between the temperatures on the upstream side and the downstream side in the supply and discharge flow path can be promptly brought within a predetermined range.

According to a third aspect of the present invention, in addition to the first aspect, when the second detection temperature is higher than the first detection temperature, the control unit controls the liquid flow forming unit to allow liquid to flow in the supply and discharge flow path until the second detection temperature is a predetermined temperature, and then the control unit controls the heating unit to heat the recording head until a difference between the first and second detection temperatures is within a predetermined range.

When the second detection temperature on the downstream side in the supply and discharge flow path is higher than the first detection temperature, the flow of liquid from the inlet toward the outlet is formed, thereby decreasing both the temperatures on the upstream side and the downstream side. Accordingly, when the first detection temperature on the upstream side is lower than a predetermined temperature such as a temperature suitable for jetting of liquid, the heating unit is operated thereafter, thereby increasing the temperature on the upstream side. Therefore, the difference between the temperatures on the upstream side and the downstream side can be brought within a predetermined range.

According to a fourth aspect of the present invention, in addition to the first aspect, the liquid supply flow path has branch flow paths branched from the supply and discharge flow path, and the branch flow paths are provided to branch from a plurality of positions between the first position and the second position.

When variation in temperature of liquid occurs in the supply and discharge flow path, variation in temperature occurs among the plurality of branch flow paths branched from the supply and discharge flow path, and further variation in temperature of liquid supplied from the branch flow paths to the nozzles may occur. According to the invention employed in such a situation, it is possible to solve variation among the branch flow paths and to suppress variation in jet characteristics of liquid jetted from the nozzles.

According to a fifth aspect of the present invention, in addition to the first aspect, the recording head has a first flow path body and a second flow path body which are connected and opposed to each other with a gap therebetween, and the supply and discharge flow path has a first portion formed in the first flow path body along the gap, a second portion formed in the second flow path body along the gap, and a communicating portion allowing the first position and second portion to communicate with each other through a communicating portion between the first flow path body and the second flow path body, and the heating unit is disposed in the gap.

Since the heating unit is disposed in the gap between the first and second flow paths, it is possible to effectively heat the first portion or the second portion formed along the gap.

According to a sixth aspect of the present invention, in addition to the fifth aspect, the second flow path body is a metal flow path body, and the heating unit is disposed on a face of the second flow path body opposed to the first flow path body.

Since the heating unit heats the second flow path body made of metal with high thermal conductivity, the temperature control based on the heating control is efficiently performed.

According to a seventh aspect of the present invention, in addition to the sixth aspect of the present invention, the second portion is opposed to the heating unit and extends in a direction along the second flow path body, and the supply and discharge flow path has a third portion that extends along the direction from a first end portion of the second flow path body to a second end portion of the second flow path body opposite to the first end portion, the third portion communicating with the second portion in the vicinity of the first end portion.

Since the third portion is formed to extend from the vicinity of one end of the second flow path body to the vicinity of the other end, it is possible to easily solve variation in temperature of the recording head by allowing liquid to flow in the third portion.

According to an eighth aspect of the present invention, in addition to the first aspect, the recording apparatus, further comprises: an actuator that applies jetting energy to liquid in the liquid supply flow path; and an electronic component that supplies a driving signal to the actuator, wherein the electronic component serves as the heating unit.

Since the electronic component supplying the driving signal to the actuator can be used also as the heating unit, it is possible to reduce the number of components.

According to a ninth aspect of the present invention, in addition to the eighth aspect, the control unit controls the recording head to be heated by supplying a driving signal from the electronic component to the actuator, the driving signal being supplied for driving the actuator so as not to jet liquid from the nozzle.

Since the electronic component is operated to the extent that liquid is not jetted from the nozzles, it is possible to heat the recording head without unnecessarily jetting liquid from the nozzles.

According to a tenth aspect of the present invention, in addition to the first aspect, the liquid flow forming unit comprises: a liquid tank that stores liquid; and a pump that allows liquid to flow from the liquid tank to the inlet, and wherein the liquid flow forming unit drives the pump so as not to break a meniscus formed in the nozzle.

Since the pump is driven to the extent that the meniscuses are not broken, it is possible to supply liquid from the liquid tank to the inlet without having a negative influence on the jet characteristics of liquid jetted from the nozzles.

What is claimed is:

1. A recording apparatus comprising:

a recording head that comprises:

an inlet for liquid;

an outlet for liquid;

a supply and discharge flow path extending from the inlet to the outlet;

a nozzle for jetting liquid; and a liquid supply flow path communicating with the supply and discharge flow path and the nozzle so as to supply liquid from the supply and discharge flow path to the nozzle, the liquid supply flow path communicating with the supply and discharge flow path at a communicating position, a liquid flow forming unit that supplies liquid from the inlet into the supply and discharge flow path and forms a flow of liquid toward the outlet in the supply and discharge flow path;

a first temperature sensor that detects temperature of the recording head;

a second temperature sensor that detects temperature of the recording head;

a heating unit that heats the recording head; and a control unit that controls the liquid flow forming unit and the heating unit on the basis of a first detection temperature detected by the first temperature sensor and a second detection temperature detected by the second temperature sensor, wherein the first temperature sensor is disposed in the vicinity of a first position between the inlet and the communicating position of the liquid supply flow path along the supply and discharge flow path, wherein the second temperature sensor is disposed in the vicinity of a second position between the outlet and the communicating position along the supply and discharge flow path, wherein the heating unit is disposed in the vicinity of a third position between the inlet and the communicating position along the supply and discharge flow path, and wherein the control unit controls the heating unit and the liquid flow forming unit to decrease differences between the first detection temperature and the second detection temperature.

2. The recording apparatus according to claim 1, wherein when the first detection temperature is higher than the second detection temperature, the control unit controls the liquid flow forming unit to allow liquid to flow in the supply and discharge flow path until a difference between the first detection temperature and the second detection temperatures is within a predetermined range.

3. The recording apparatus according to claim 1, wherein when the second detection temperature is higher than the first detection temperature, the control unit controls the liquid flow forming unit to allow liquid to flow in the supply and discharge flow path until the second detection temperature is a predetermined temperature, and then the control unit controls the heating unit to heat the recording head until a difference between the first and second detection temperatures is within a predetermined range.

4. The recording apparatus according to claim 1, wherein the liquid supply flow path has branch flow paths branched from the supply and discharge flow path, and wherein the branch flow paths are provided to branch from a plurality of positions between the first position and the second position.

5. The recording apparatus according to claim 1, wherein the recording head has a first flow path body and a second flow path body which are connected and opposed to each other with a gap therebetween, wherein the supply and discharge flow path has a first portion formed in the first flow path body along the gap, a second portion formed in the second flow path body along the gap, and a communicating portion allowing the first position and second portion to communicate with each other through a communicating portion between the first flow path body and the second flow path body, and wherein the heating unit is disposed in the gap.

6. The recording apparatus according to claim 5, wherein the second flow path body is a metal flow path body, and wherein the heating unit is disposed on a face of the second flow path body opposed to the first flow path body.

7. The recording apparatus according to claim 5, wherein the second portion is opposed to the heating unit and extends in a direction along the second flow path body, and wherein the supply and discharge flow path has a third portion that extends along the direction from a first end portion of the second flow path body to a second end portion of the second flow path body opposite to the first end portion, the third portion communicating with the second portion in the vicinity of the first end portion.

8. The recording apparatus according to claim 1, further comprising:

an actuator that applies jetting energy to liquid in the liquid supply flow path; and an electronic component that supplies a driving signal to the actuator, wherein the electronic component serves as the heating unit.

9. The recording apparatus according to claim 8, wherein the control unit controls the recording head to be heated by supplying a driving signal from the electronic component to the actuator, the driving signal being supplied for driving the actuator so as not to jet liquid from the nozzle.

10. The recording apparatus according to claim 1, wherein the liquid flow forming unit comprises:

a liquid tank that stores liquid; and a pump that allows liquid to flow from the liquid tank to the inlet, and wherein the liquid flow forming unit drives the pump so as not to break a meniscus formed in the nozzle.

* * * * *